US007765655B2

(12) United States Patent
Dannenberg

(10) Patent No.: US 7,765,655 B2
(45) Date of Patent: Aug. 3, 2010

(54) APPARATUS AND METHOD FOR GENERATING POST-BURIAL AUDIO COMMUNICATIONS IN A BURIAL CASKET

(76) Inventor: Jeff Dannenberg, 40 Hendricks Isle, Fort Lauderdale, FL (US) 33025

( * ) Notice: Subject to any disclaimer, the term of this patent is extended or adjusted under 35 U.S.C. 154(b) by 0 days.

(21) Appl. No.: 12/334,604

(22) Filed: Dec. 15, 2008

(65) Prior Publication Data

US 2010/0146750 A1 Jun. 17, 2010

(51) Int. Cl.
*A61G 17/00* (2006.01)

(52) U.S. Cl. ..... 27/31; 27/2; 360/12; 369/19

(58) Field of Classification Search ..... 27/31, 27/2, 1; 360/12; 369/69; 40/455, 124.5; 52/103–104
See application file for complete search history.

(56) References Cited

U.S. PATENT DOCUMENTS

| | | | | |
|---|---|---|---|---|
| 1,214,319 A | | 1/1917 | Kennedy et al. | |
| 4,304,076 A | * | 12/1981 | Splendora | 52/104 |
| 4,367,461 A | | 1/1983 | Gauchard | |
| 5,277,452 A | | 1/1994 | Skidmore | |
| 5,404,343 A | | 4/1995 | Boggio | |
| 5,729,921 A | | 3/1998 | Rojas | |
| 5,987,720 A | * | 11/1999 | Yamamoto | 27/35 |
| 6,324,736 B1 | | 12/2001 | Atrio | |
| 6,980,107 B1 | | 12/2005 | Ziegler | |
| 7,089,495 B2 | | 8/2006 | Barrows | |
| 2003/0208890 A1 | | 11/2003 | Kim | |

* cited by examiner

*Primary Examiner*—William L. Miller
(74) *Attorney, Agent, or Firm*—Mark D. Bowen, Esq.; Malin Haley DiMaggio Bowen & Lhota, P.A.

(57) ABSTRACT

An apparatus and method for generating post-burial audio communications from surviving friends and loved ones in a casket by providing a burial casket, and providing an electronic audio communication system for placement in said casket to automatically electronically generate post-burial communications in said casket. The burial casket is thus adapted with an audio message system containing electronically stored audio and music files that are automatically played in accordance with a programmed schedule thereby allowing surviving members means for communicating to the deceased for a period of time after burial. An electronic device having a data storage system for storing recorded audio, such as messages from family and friends, music, or any other suitable audio file is provided. A timing mechanism maintains track of the date, day, and time, to allow for the selective broadcast of audio content automatically in accordance with user programmed and selected scheduling. A battery power source provides electrical power for the system. The present invention thus provides surviving family and friends with a means of automatically communicating messages and sounds to the deceased after burial.

7 Claims, 3 Drawing Sheets

Figure 1:
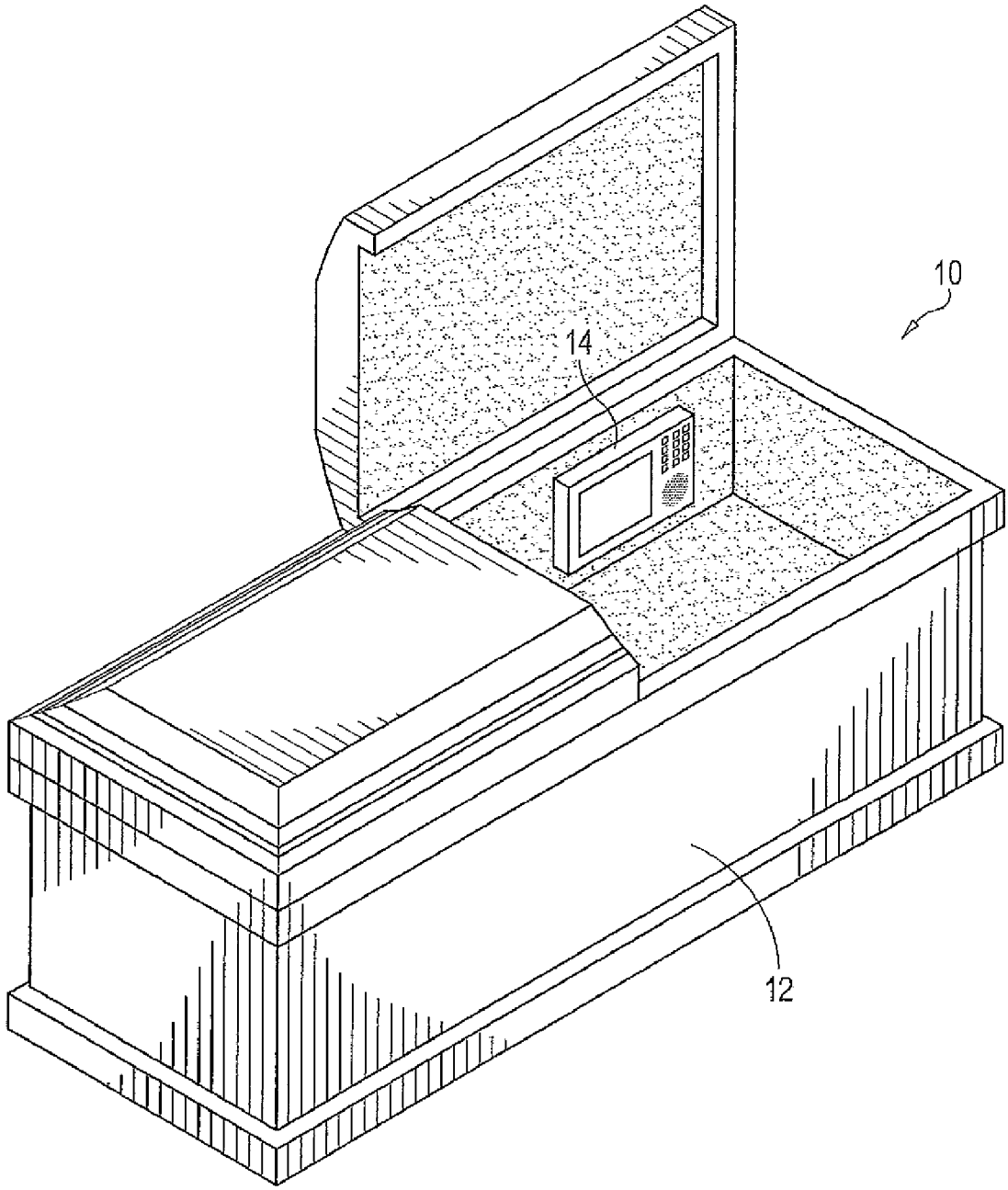

APPARATUS AND METHOD FOR GENERATING POST-BURIAL AUDIO COMMUNICATIONS IN A BURIAL CASKET

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to burial caskets and coffins, and more particularly to an apparatus and method for generating post-burial audio communications in a casket, and more particularly to a burial casket adapted with an audio message system containing electronically stored audio and music files that are automatically played in accordance with a programmed schedule thereby allowing surviving members means for communicating to the deceased for a period of time after burial.

2. Description of Related Art

The passing of family members and loved ones is a time of deep sorrow for the surviving family and friends. Surviving members often wish that they could communicate thoughts and messages to the deceased even after burial as a hopeful means of providing comfort a recently lost loved one.

The prior art reveals a number of advancements directed to enhancing the burial and memorial of departed loved ones. For example, U.S. Pat. No. 1,214,319, issued to Kennedy et al., discloses a burial monument adapted for exhibiting pictures of the deceased. U.S. Pat. No. 5,404,343, issued to Boggio, discloses a resting place marker, such as a grave or tombstone, with an audio system that broadcasts an epitaph, music, poems, stories, or voice messages from the deceased to the world or loved ones. Boggio teaches the need to provide a durable system due to the exposure to the elements. U.S. Pat. No. 5,729,921, issued to Rojas, discloses a burial marker and display box for the preservation of memorabilia and/or ashes of the individual. The device may include recorded audio or video so that individuals may actually hear a deceased individual speak. The device is constructed to be air and watertight to resist the onslaught of the elements. U.S. Pat. No. 6,324,736, issued to Atrio, discloses adapting a funeral casket with a video display capable of playing a recording or other message containing visual images at a funeral service to be observed by mourners at the casket. U.S. Pat. No. 6,980,107, issued to Ziegler, discloses an audio visual display system for use at an interment or memorial site to provide information to users about the individual buried at the location. Similarly, U.S. Pat. No. 7,089,495, issued to Barrows, discloses a video enhanced tombstone for communicating audio and visual data related to the deceased from the tombstone to the user.

Finally, Published Patent Application US 2003/0208890, to Kim, discloses a casket link for providing real time multimedia communications between a deceased and bereaved members of a family. The system essentially comprises a wireless communications system and does not provide for automatically generating pre-recorded audio communications to the deceased according to user selected date and time.

The prior art referenced above is largely devoted to communicating images, messages, and video about the deceased to the living. Often times, however, surviving loved ones have a desire to have messages broadcast to the deceased in the hope of providing some level of spiritual comfort and expressions of love. Accordingly, there remains a need for providing a casket with an electronic system adapted for automatically generating audible output messages directed to the deceased after burial. There further exists a need for such a system capable of playing pre-recorded audio messages selected based on date and/or time.

BRIEF SUMMARY OF THE INVENTION

The present invention overcomes the limitations and disadvantages present in the art by providing an apparatus and method for generating post-burial audio communications in a burial casket (e.g. coffin) by adapting the casket with an audio message system containing electronically stored audio and music files that are automatically played in accordance with a programmed schedule thereby allowing surviving members means for communicating to the deceased for a period of time after burial. An audio message system in accordance with the present invention comprises an electronic device having a data storage system for storing recorded audio files, such as messages from family and friends, music, or any other suitable audio file. A timing mechanism maintains track of the date, day, and time, to allow for the selective broadcast of audio content automatically in accordance with user programmed and selected scheduling. A battery power source provides electrical power for the system. The present invention thus provides survivors with a means of communicating messages and sounds to the deceased after burial.

Accordingly, it is an object of the present invention to provide an audio communication system for automatically generating audio messages within a burial casket after burial.

Another object of the present invention is to provide such a system wherein messages may be selectively broadcast in accordance with a user selected schedule.

In accordance with these and other objects, which will become apparent hereinafter, the instant invention will now be described with particular reference to the accompanying drawings.

BRIEF DESCRIPTION OF THE SEVERAL VIEWS OF TEE DRAWINGS

Figure 2:
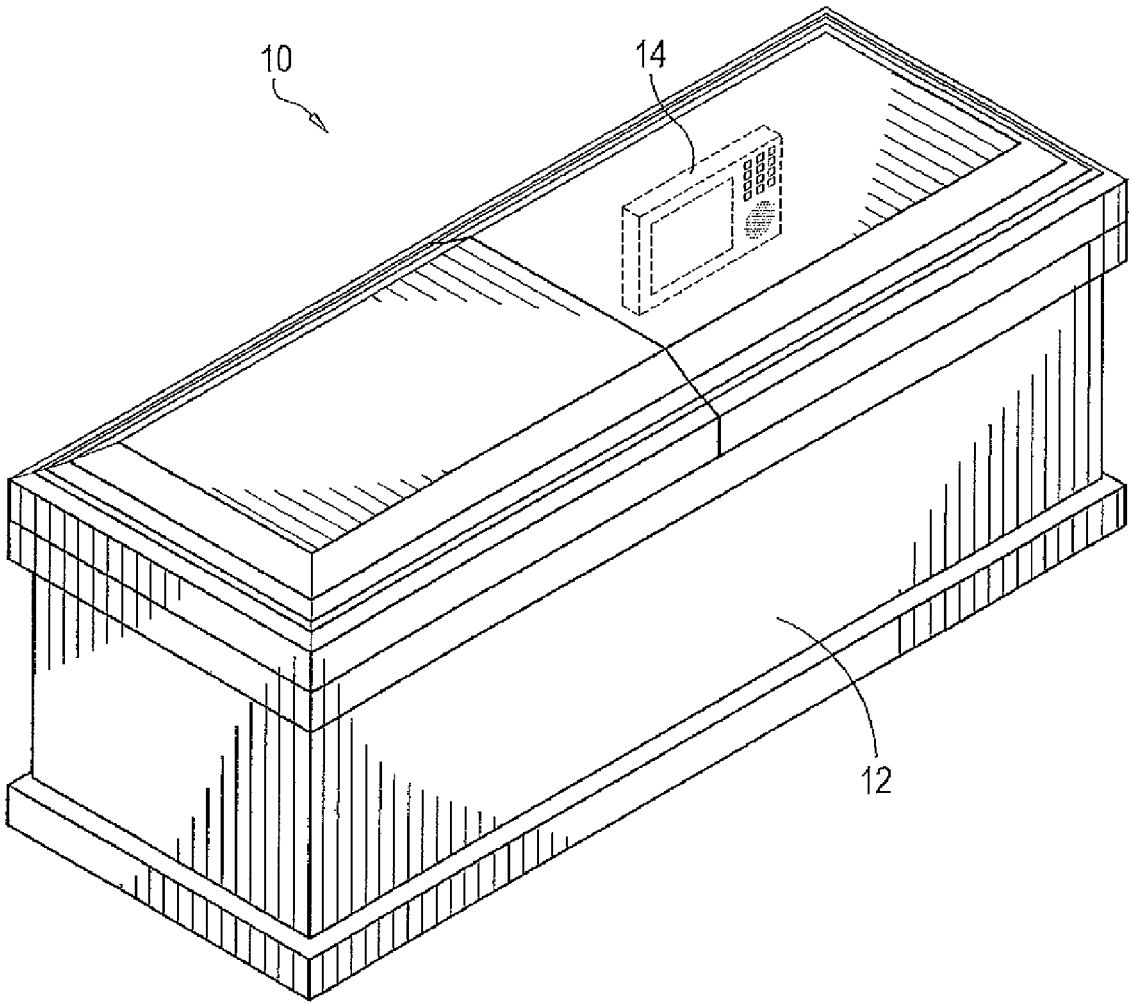
Figure 3:
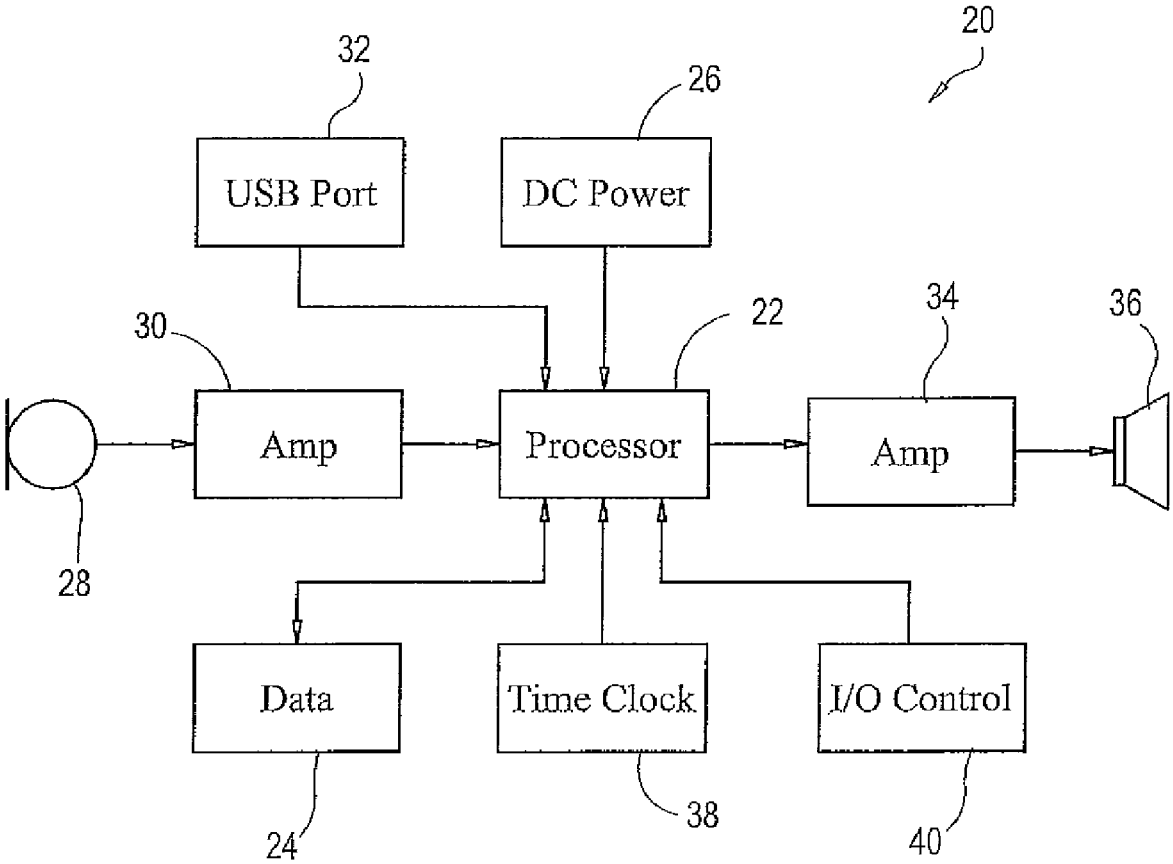

FIGS. 1 and 2 illustrate a burial casket having an automatic message system for generating post burial audio messages to the deceased in accordance with the present invention; and FIG. 3 is an electrical block diagram for an automatic message system of the present invention.

DETAILED DESCRIPTION OF THE INVENTION

With reference now to the drawings, FIGS. 1-3 depict a burial casket audio message system, generally referenced as 10, in accordance with the present invention. Burial casket system 10 comprises a casket 12 adapted with an internally mounted audio message system 14. Burial casket 12 is preferably a funerary box of the type used in the display and containment of deceased remains, either for burial or cremation. The present invention relates to any type of casket, particularly those used for human remains as well as those used to contain the remains of an animal—such as a pet. As illustrated in FIG. 1, casket 12 includes an electronic audio message system 14 having electronically stored audio and music files that are automatically played in accordance with a programmed schedule thereby allowing surviving members means for communicating to the deceased for a period of time after burial in accordance with the present invention.

Turning now to FIG. 3 there is depicted an electrical schematic block diagram, generally referenced as 20, for an electronic audio message system 14 in accordance with the present invention. The audio message system comprises an electronic system including a processor 22 electronically connected to a data storage device 24. Processor 22 preferably comprises a microprocessor having a central processing unit (CPU) on a computer chip as part of a microcomputing system. Data storage device 24 may comprise any suitable data storage device or memory component or media that retains digital computer data including random access memory (RAM), memory card technology, flash drive, optical drive, or hard drive. Data storage device 24 is capable of storing and retrieving information (i.e. data). A battery 26 is electrically connected for providing electrical power for the system. The battery is intended to provide power for a period of time depending on the number, length, and frequency of message play. In an alternate embodiment, an above-ground solar panel may be provided to charge battery 26. Audio message system 14 further includes input components to allow for audio and/or music files to be electronically input for storage on data storage device 28. Audio input components preferably include a microphone 28 and amplifier 30 to allow audible messages, sounds, and music to be input for recorded storage in data storage device 24. As a result, family and friends of the deceased are able to input messages in their own voices for automatic playback as more fully discussed herein below. In addition, one or more input ports 32 may be provided to allow users to download digital data directly to audio message system 14 using computer hardware, including USB cable link from a computer, or other suitable data transmission connection between electronic devices. Audio message system 14 further includes output components to allow for audio and/or music files to be electronically output. Audio output components preferably include an audio amplifier 34 and a speaker 36 in electronic communication with processor 22. As should be apparent amplifier 34 and speaker 36 function to allow the system to generate audio output from recorded information contained in data storage device 24.

Audio message system 14 further includes a digital time clock 38 in electronic communication with processor 22. Digital time clock 38 functions to maintain time, day, and date information. Digital time clock 38 may comprise any suitable digital timer, computer timer, or timing circuit. In addition, audio message system 14 includes a scheduling input/output controller 40 that allows the system to be adapted to generate audio output based on user specified scheduling parameters. Scheduling input/output controller 40 allows for the system to be programmed to generate selected audio output at predetermined times. By way of example, controller 40 may be used by surviving family member (or friend) to program the system so that a particular recorded message (e.g. "Happy Birthday," "Merry Christmas," "Happy Anniversary," etc.) is automatically generated as audio output via speaker 36 on the deceased's date of birth as tracked by digital time clock 38. As should now be apparent, the present invention allows for surviving family and friends to communicate virtually any message to the deceased based in accordance with programmed scheduling thus providing survivors with a means of communicating messages and sounds to the deceased after burial.

In an alternate embodiment, audio message system may further be adapted as a wireless receiver for receiving wireless communications from a transmitter such that family members and friends are able to communicate in real-time with the deceased via message system 14.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A method for generating post-burial audio communications in a burial casket, which comprises:

(a) providing said burial casket for a deceased;

(b) providing an electronic audio communication system said electronic audio communication system including, a housing, a computer processor mounted within said housing, a battery electrically connected to said computer processor, a data storage device in electrical communication with said computer processor, time clock means, in electrical communication with said computer processor, for keeping track of the date and time, means for inputting audio data for storage on said data storage device, means for programming output of selected audio data from said data storage device in accordance with a user selected schedule which is date and time dependent, a speaker in electronic communication with said computer processor, said audio communication system functioning to automatically generate selected audio output corresponding to said audio data stored on said data storage device in response to said user selected schedule;

(c) placing said communication system in said casket with the deceased;

(d) burying said casket in the ground; and (e) said communication system automatically electronically generating pre-recorded post-burial communications in said casket in accordance with said user selected and programmed schedule.

2. A method for generating post burial audio communications in a burial casket according to claim 1 wherein said means for inputting audio data includes a microphone.

3. A method for generating post burial audio communications in a burial casket according to claim 1, wherein said means for inputting audio data includes a USB port.

4. A method for generating post burial audio communications in a burial casket according to claim 1, wherein said means for programming output of selected audio data from said data storage device includes a plurality of input keys.

5. A method for generating post burial audio communications in a burial casket according to claim 1, further including means for mounting the electronic audio communication system in said burial casket.

6. A method for generating post burial audio communications in a burial casket according to claim 1, wherein said audio data includes a personal message to be recorded by a surviving friend or loved one using said microphone.

7. A method for generating post-burial audio communications in a casket, which comprises:

(a) providing said burial casket for a deceased;

(b) providing an electronic audio communication system for placement in said casket, said electronic audio communication system including, a housing, a computer processor mounted within said housing, a battery electrically connected to said computer processor, a data storage device in electrical communication with said computer processor, time clock means, in electrical communication with said computer processor, for keeping track of the date and time, means for inputting audio data for storage on said data storage device, means for programming output of selected audio data from said data storage device in accordance with a user selected schedule which is date and time dependent, a speaker in electronic communication with said computer processor, said audio communication system functioning to automatically generate selected audio output corresponding to audio data stored on said data storage device;

(c) inputting audio data for storage on said data storage device;

(d) programming output of selected audio data from said data storage device;

(e) placing said electronic audio communication system in said burial casket;

(f) burying said casket in the ground; and (g) said communication system automatically electronically generating pre-recorded post-burial communications in said casket in accordance with said user selected schedule.

* * * * *